United States Patent [19]

Ludwig

[11] 4,091,706

[45] May 30, 1978

[54] CONSTRUCTION OF ILLUMINATED DRUMS

[75] Inventor: William Frederick Ludwig, Oak Brook, Ill.

[73] Assignee: Ludwig Industries, Chicago, Ill.

[21] Appl. No.: 730,184

[22] Filed: Oct. 6, 1976

[51] Int. Cl.[2] ..... G10D 13/02

[52] U.S. Cl. ..... 84/411 R; 84/464; 362/252

[58] Field of Search ..... 84/411–421, 84/464 A; 240/2 L, 10 R

[56] References Cited

U.S. PATENT DOCUMENTS

| | | | |
|---|---|---|---|
| 881,109 | 3/1908 | Cipar | 84/412 |
| 3,019,685 | 2/1962 | Davis | 84/411 |
| 3,626,458 | 12/1971 | Zickos | 84/411 |
| 3,995,152 | 11/1976 | Chao et al. | 240/10 R |

*Primary Examiner*—Lawrence R. Franklin
*Attorney, Agent, or Firm*—W. Melville Van Sciver

[57] ABSTRACT

A drum shell for musical instruments formed of clear plastic material such as methyl methacrylate from hollow cylindrical sections joined together wherein a source of illumination is secured to the drum shell by brackets which are, in turn, secured to the drum shell opposite standard lugs for attaching the head of the drum and wherein the source of the illumination is an elongated tubular element or elements which are positioned inside the shell substantially adjacent the place where the sections of the shells are secured together.

4 Claims, 4 Drawing Figures

CONSTRUCTION OF ILLUMINATED DRUMS

BACKGROUND OF THE INVENTION

This invention relates generally to drumshells formed of thermoplastic material such as methyl methacrylate which comprise sections of generally hollow cylindrical forms secured together at a generally horizontal location with illuminated light sources secured to the internal walls of the completed shell substantially at the position where they are joined together. The securing means comprise brackets which are secured to the internal walls of the shell at a position opposite the standard drum lugs which retain the rings in which the heads are secured so that the securing means for the brackets are obscured. Prior to my invention, various sources of illumination have been placed inside of drum shells, but to the best of my knowledge, none have been in tubular form secured by obscured brackets.

SUMMARY OF THE INVENTION

In accordance with this invention, it has been found that drum shells of clear plastic material may be provided with internal illumination which enchance the appearance of the drum and may be utilized with clear plastic material of various colors to provide a pleasing and novel appearance.

DESCRIPTION OF THE PREFERRED EMBODIMENT

Figure 1:
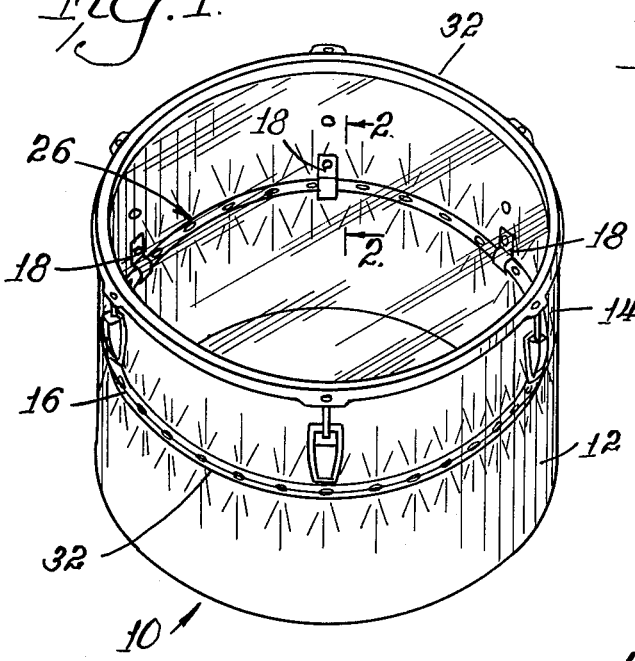
FIG. 1 is a perspective view of a drum shell formed of methyl methacrylate sections joined together with a tubular illuminating means secured interially by internal brackets.
Figure 2:
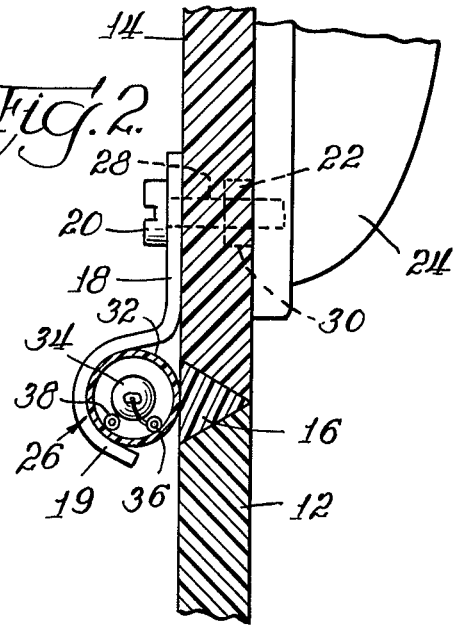
FIG. 2 is a sectional view of the shell taken along lines 2—2 of FIG. 1.

Referring to FIGS. 1 and 2, a transparent drum shell designated generally by numeral 10 is formed by gluing together by a joint 16 two hollow cylindrical sections 12 and 14. Brackets, generally indicated at 18, are secured at their upper extremities by bolts 20 which extend through holes 28 in the drum shell and are secured into bosses 22 that are interially threaded and piloted in a counterbored portion 30 of holes 28 and into standard lugs 24 which are positioned externally of the drum shell 10. The lugs 24 secure standard rings 32 which in turn secure the head retaining rings and drum head (not shown) to the shell 10. The heads may be of opaque or clear "Mylar".

The brackets 18 are generally U-shaped at their lower extremities as shown in 19, and a tubular illuminated means 26 of standard form is secured by the U-shaped portions 19 of the brackets, preferably adjacent the glued joint 16 between the upper and lower portions 12 and 14 of the shell.

Figure 3:
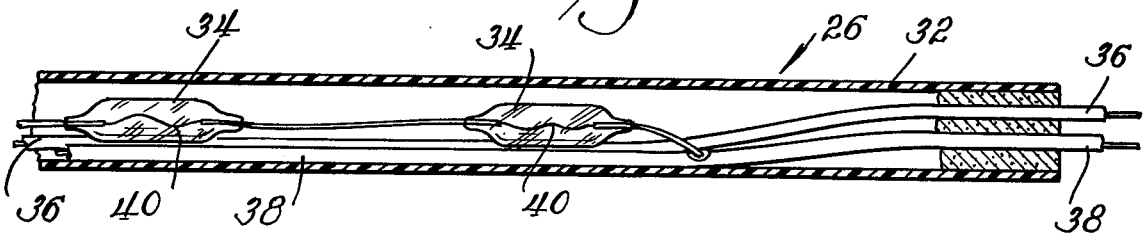
FIG. 3 is a partial sectional view of the preferred tubular illuminating means.
Figure 4:
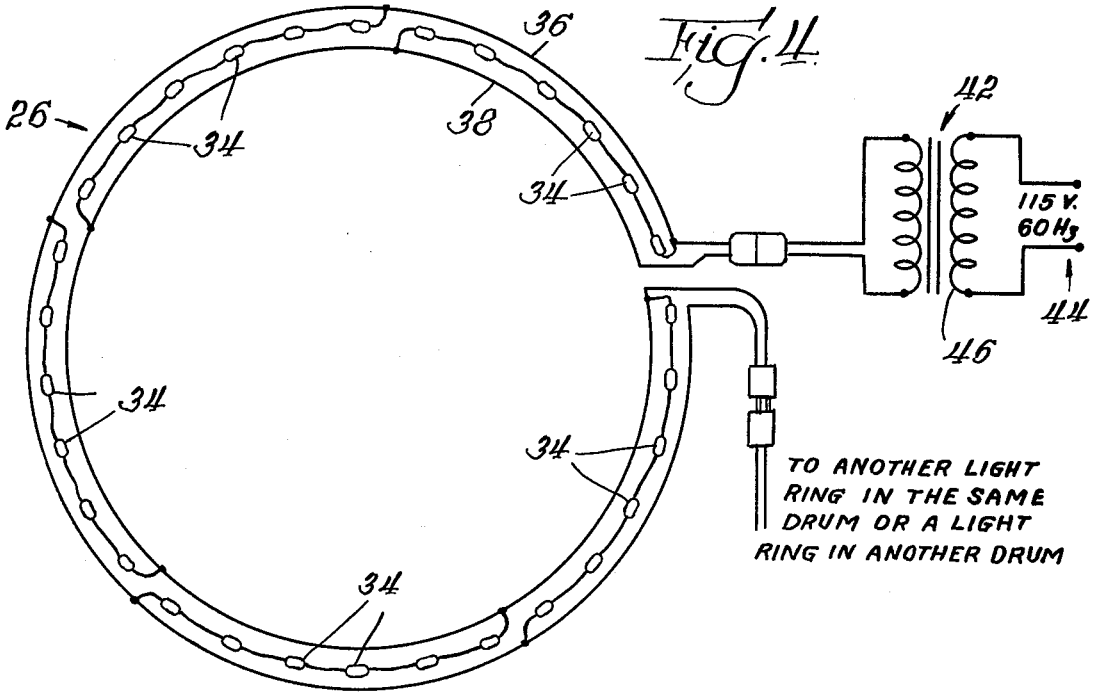
FIG. 4 is a view of the tubular illuminating means in circular form and shows electrical connections of the illuminating means.

The illuminating means generally indicated at 26 is shown in detail in FIGS. 3 and 4 and comprise transparent tubular members 32 which contain a number of bulbs 34 which are connected together by electric wires 36 and 38. The bulbs 34 each contain a wire 40 which becomes incandescent when power is supplied thereto from a suitable source as shown in FIG. 4 at 42. The power source 42 is derived from a standard 115 volt line as indicated at 44 through a step-down transformer 46. While this specific tubular illuminating means does not, per se, form a part of my invention, it is nevertheless very useful in this particular application. When the bulbs 34 are illuminated, they provide specific light sources interially of the shell 10 and the illumination extends between the bulbs 34 of less intensity which is observable between the tubes 32. Furthermore, by attaching the brackets 18 opposite the lugs 24, most of the bracket portions are obscured from the direct vision of the observer.

The tubular illuminating means 26 are known generally in the trade as "Tivoli" lights and are similar to the illuminating means that are used in many applications. The "Tivoli" lights are light in weight and are energized from a low voltage source so that they consume very little electrical power and are safe. The tubing is usually preferably made from flexible "Lexan" because it is easy to bend to follow the contour of the interior of the shell, it being clamped to hold it in place.

From the foregoing, it is apparent that I have provided a novel interior illumination for transparent drum shells. Furthermore, since the shells may be formed of a plurality of sections connected together which may be of different colors or may be of clear plastic material, novel lighting effects are obtained which are attractive to an audience viewing the drums in actual use. The provision of the interior illumination adds very little weight to the drum since the tubular lights are light in weight and very little additional connections are required for the illuminating means.

What is claimed is:

1. An illuminated drum for use as a percussion musical instrument comprising a shell formed, at least in part, of transparent material, said shell being of generally cylindrical shape to form a chamber with openings at both ends thereof, a drum head covering at least one end of the shell, means for securing said drum head to the shell, said securing means including lugs spaced around the shell externally thereof and also including a drum ring for retaining said head, which ring is attached to the shell by said lugs, an electrical light source, a tube of electrically insulating material in which said light source is contained, means for securing said tube internally of the shell and a source of electricity for energizing said light source, said means for securing said tube to said shell comprising a series of brackets on the inside of the shell contacting said tube and means extending through the shell for securing the brackets on the inside thereof to the lugs on the outside thereof with the shell and the tube therebetween.

2. An illuminated drum as claimed in claim 1 wherein said tubing is, at least in part, flexible.

3. An illuminated drum as claimed in claim 1 wherein the means for securing the brackets and lugs together comprise a bolt extending from the interior of the shell through the brackets and into threaded recesses in the lugs.

4. An illuminated drum as claimed in claim 1 wherein the drum shell is formed from at least two cylindrical sections having meeting edges and means for fastening the meeting edges of the sections together, said means for securing the brackets and lugs together being positioned adjacent to said meeting edges.

* * * * *